US008581087B2

(12) United States Patent
Hashimoto

(10) Patent No.: US 8,581,087 B2
(45) Date of Patent: Nov. 12, 2013

(54) TONE GENERATING STYLE NOTIFICATION CONTROL FOR WIND INSTRUMENT HAVING MOUTHPIECE SECTION

(75) Inventor: Ryuji Hashimoto, Hamamatsu (JP)

(73) Assignee: Yamaha Corporation (JP)

( * ) Notice: Subject to any disclaimer, the term of this patent is extended or adjusted under 35 U.S.C. 154(b) by 24 days.

(21) Appl. No.: 13/241,602

(22) Filed: Sep. 23, 2011

(65) Prior Publication Data

US 2012/0073424 A1 Mar. 29, 2012

(30) Foreign Application Priority Data

Sep. 28, 2010 (JP) ..... 2010-217709
Sep. 28, 2010 (JP) ..... 2010-217710

(51) Int. Cl.
*G10H 1/06* (2006.01)

(52) U.S. Cl.
USPC ..... 84/735; 84/615; 84/616; 84/622; 84/723

(58) Field of Classification Search
None
See application file for complete search history.

(56) References Cited

U.S. PATENT DOCUMENTS

| | | | | |
|---|---|---|---|---|
| 5,922,985 | A * | 7/1999 | Taniwaki | 84/742 |
| 5,929,361 | A * | 7/1999 | Tanaka | 84/742 |
| 6,002,080 | A * | 12/1999 | Tanaka | 84/615 |
| 6,653,546 | B2 * | 11/2003 | Jameson | 84/735 |
| 6,737,572 | B1 * | 5/2004 | Jameson et al. | 84/741 |
| 7,470,852 | B2 * | 12/2008 | Masuda | 84/615 |
| 7,772,482 | B2 * | 8/2010 | Shibata | 84/734 |
| 7,781,667 | B2 * | 8/2010 | Shibata | 84/723 |
| 8,309,837 | B2 * | 11/2012 | Hashimoto | 84/737 |
| 2003/0066414 | A1 * | 4/2003 | Jameson | 84/741 |
| 2007/0017346 | A1 * | 1/2007 | Masuda | 84/600 |
| 2007/0137468 | A1 * | 6/2007 | Shibata | 84/723 |
| 2008/0314226 | A1 * | 12/2008 | Shibata | 84/384 |
| 2012/0017749 | A1 * | 1/2012 | Hashimoto | 84/600 |
| 2012/0073424 | A1 * | 3/2012 | Hashimoto | 84/622 |

FOREIGN PATENT DOCUMENTS

| | | | |
|---|---|---|---|
| EP | 1748416 | A1 | 1/2007 |
| EP | 2006834 | A1 | 12/2008 |
| GB | 2328553 | A | 2/1999 |
| JP | 06-043867 | A | 2/1994 |
| JP | 2010-048909 | A | 3/2010 |
| WO | 2008/141459 | A1 | 11/2008 |

OTHER PUBLICATIONS

Extended European Search Report issued Mar. 5, 2012 for corresponding EP11182895.0.
European Search Report issued in European counterpart application No. EP13172476.7, dated Sep. 16, 2013.

* cited by examiner

*Primary Examiner* — Marlon Fletcher
(74) *Attorney, Agent, or Firm* — Rossi, Kimms & McDowell LLP

(57) ABSTRACT

Detection is made of a physical amount caused by operation performed on a mouthpiece with a human player's mouth, and a tone pitch corresponding to the detected physical amount is identified by referencing a memory storing information defining relationship between various ranges of the physical amount and tone pitches. Expected tone generating style is notified to the player based on the identified tone pitch. The memory contains a pitch table defining relationship between various ranges of the physical amount and tone pitches, and a gain table defining gain information corresponding to deviations of the physical amount from a predetermined reference point for each tone pitch and within the range of the physical amount corresponding to the tone pitch. For the detected physical amount, a tone pitch and gain information are identified by referencing the pitch gain tables, so that the identified tone pitch and gain information is notified.

16 Claims, 10 Drawing Sheets

| BREATH PRESSURE | TONE VOLUME LEVEL |
|---|---|
| P1≦P<P2 | LEVEL 1 |
| P2≦P<P3 | LEVEL 2 |
| P3≦P<P4 | LEVEL 3 |

130

TONE GENERATING STYLE NOTIFICATION CONTROL FOR WIND INSTRUMENT HAVING MOUTHPIECE SECTION

BACKGROUND

The present invention relates to tone generating style notification control for wind instruments having a mouthpiece section.

Japanese Patent Application Laid-open Publication No. HEI-6-43867 (hereinafter referred to as "patent literature 1") discloses an electronic wind instrument which simulates performance operation and tone color (timbre) of a wind instrument. The electronic wind instrument disclosed in patent literature 1 includes a mouthpiece section, and, in response to a human player performing, with a finger, operation for designating a tone color and pitch within an octave pitch range, the electronic wind instrument generates a tone corresponding to the designated tone color and pitch. Further, Japanese Patent Application Laid-open Publication No. 2010-48909 discloses an audio processing apparatus which outputs a tone of a wind instrument based on an octave corresponding to an angle at which a body device has been inclined by a human player and a note name corresponding to depressing operation performed by the human player.

With a real, acoustic or natural wind instrument, harmonics responsive to human player's piston operation are sounded while resonating in accordance with a state of human player's lips applied to the mouthpiece. However, with the conventionally-known electronic wind instruments, where a human player designates a desired tone pitch using a finger of its (i.e., his or her) hand, a performance feeling felt by the human player is completely different from an actual performance feeling (i.e., performance feeling felt by a human player when performing an acoustic or natural wind instrument).

SUMMARY OF THE INVENTION

In view of the foregoing prior art problems, it is an object of the present invention to provide an improved technique which allows a tone, desired by a human player, to be generated with a performance feeling approximate to that of an acoustic or natural wind instrument.

In order to accomplish the above-mentioned object, the present invention provides an improved tone generating style notification control apparatus for a musical instrument having a mouthpiece section, the mouthpiece section being operable with a mouth of a human player, which comprises: a detector which detects a physical amount caused by operation performed on the mouthpiece section with the mouth of the human player; a storage section which stores therein information defining relationship between various values or ranges of the physical amount and tone pitches; an identification section which, by referencing the storage section, identifies a tone pitch corresponding to the physical amount detected via the detector; and a notification section which notifies the human player of an expected tone generating style on the basis of the tone pitch identified by the identification section, the expected tone generating style being a style of a tone expected to be generated by the musical instrument in response to the operation performed on the mouthpiece section with the mouth of the human player.

According to the present invention constructed in the aforementioned manner, the human player can ascertain, on the basis of the expected tone generating style notified by the notification section, what tone pitch the operation performed on the mouthpiece section with the mouth of the human player corresponds to, and thus, feedback to the human player can be made effectively to thereby allow the human player to appropriately operate the mouthpiece section for achieving a desired tone pitch.

According to another aspect of the present invention, there is provided an improved tone generating style notification control apparatus for a musical instrument having a mouthpiece section, the mouthpiece section being operable with a mouth of a human player, which comprises: a detector which detects a physical amount caused by operation performed on the mouthpiece section with the mouth of the human player; a first storage section which stores therein a tone pitch table defining relationship between various ranges of the physical amount and tone pitches; a second storage section which stores therein a gain table defining, as gain information, values corresponding to deviations of the physical amount from a predetermined reference point, for each tone pitch and within the range of the physical amount corresponding to the tone pitch; an identification section which, with regard to the physical amount detected by the detector, identifies a tone pitch by referencing the tone pitch table and identifies gain information by referencing the gain table; and a notification section which notifies the human player of the tone pitch and the gain information identified by the identification section.

According to the present invention thus constructed, the human player can ascertain, on the basis of the notification by the notification section, what tone pitch and gain the operation performed on the mouthpiece section with the mouth of the human player corresponds to, and thus, feedback to the human player can be made effectively to thereby allow the human player to appropriately operate the mouthpiece section for achieving a desired tone pitch and gain. Thus, the human player can, for example, cause a desired tone to be generated by operating the mouthpiece section with its (his or her) mouth as if he were playing a natural wind instrument. Further, by associating the reference points of the individual tone pitches with resonance points of the wind instrument, the present invention allows the human player to ascertain, on the basis of the notified gain information, a degree of resonance corresponding to the operation performed on the mouthpiece section.

According to still another aspect of the present invention, there is provided an improved musical instrument, which comprises: the aforementioned tone generating style notification control apparatus; the mouthpiece section; an operation section operable with a finger of a human player; a tone generation mechanism which generates a tone on the basis of a combination of operation performed on the mouthpiece section with a mouth of the human player and operation performed on said operation section with the finger of the human player.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

A tone generating style notification control of the present invention is suited for application to musical instruments and particularly suited for use in electronic wind instruments, and embodiments of the tone generating style notification control apparatus of the present invention will hereinafter be described as used in a trumpet-type electronic wind instrument.

First Embodiment

<Outer Appearance>

Figure 1:
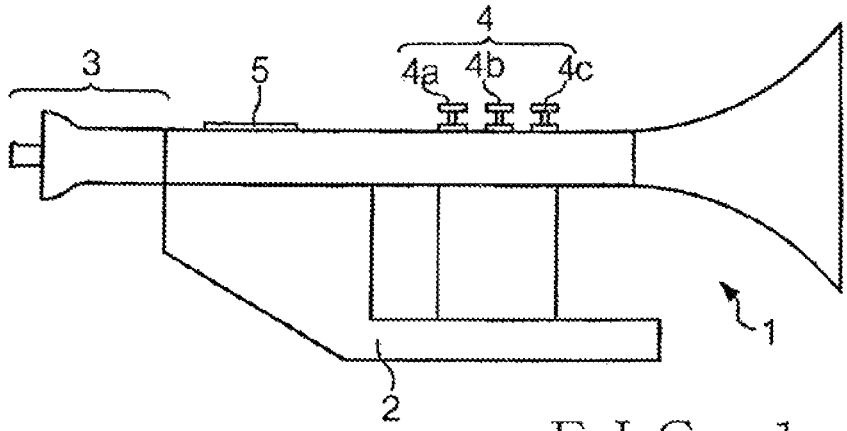
FIG. 1 is a view showing an example outer appearance of an electronic wind instrument to which is applied (i.e., which employs) a first embodiment of a tone generating style notification control apparatus of the present invention.

FIG. 1 is a view showing an outer appearance of the electronic wind instrument 1 employing the first embodiment of the tone generating style notification control apparatus of the present invention. The electronic wind instrument 1 includes a body casing (body section of the instrument 1) 2 simulating a shape of an acoustic or natural trumpet, a mouthpiece unit 3 through which a human player (or user) blows breath into the instrument 1, and a piston operation section (operation section) 4 and a display section 5 provided on the body casing 2. The display section 5 is provided at such a position where the human player playing the wind instrument 1 can easily view the display section 5.

The piston operation section 4 includes three pistons, i.e. first piston 4*a*, second piston 4*b* and third piston 4*c*. Each of the pistons 4*a* to 4*c* is constructed to be depressed by a human player's finger into the body casing 2, and each of the pistons 4*a* to 4*c* is provided with a switch (detector or detection section) for detecting whether or not the piston in question has been depressed into the body casing 2 by the human player. The following describe details of the mouthpiece unit 3.

<Mouthpiece Unit>

Figure 2A:
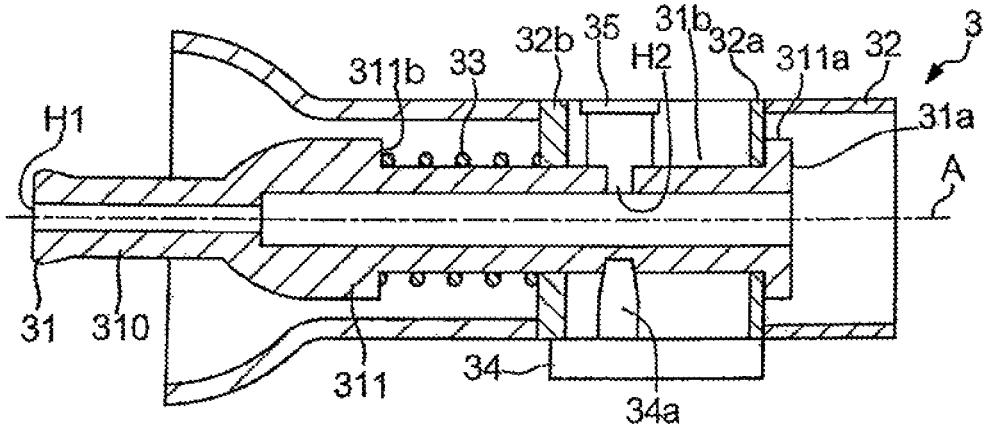
FIGS. 2A and 2B are sectional views showing the interior of a mouthpiece unit employed in the electronic wind instrument employing the first embodiment of the tone generating style notification control apparatus.
Figure 2B:
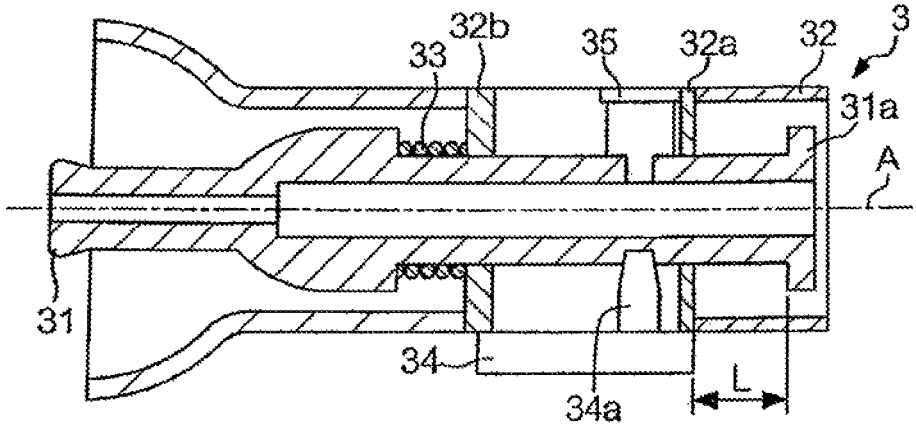

FIGS. 2A and 2B are sectional views showing the interior of the mouthpiece unit 3 employed in the instant embodiment. As shown in FIG. 2A, the mouthpiece unit 3 includes a mouthpiece section 31 in the form of a cylindrical member (cylinder) having a diameter increasing in a rightward direction of FIG. 2A, and a mouthpiece casing 32 in the form of a cylindrical member having a diameter increasing in a leftward direction of FIG. 2A. The mouthpiece section 31 and the mouthpiece casing 32 are disposed concentrically about a center axis A.

The mouthpiece section 31 includes a small-diameter portion 310 to be held in the human player's mouth (or between the lips of the human player), and a large-diameter portion 311 greater in diameter than the small-diameter portion 310. The large-diameter portion 311 of the mouthpiece section 31 has an annular recessed portion 31*b* formed in the outer periphery thereof. An end surface 311*b* of the annular recessed portion 31*b* closer to the small-diameter portion 310 supports one end of a coil-shaped compression spring 33 wound around the outer periphery of the annular recessed portion 31*b*. An annular portion of the large-diameter portion 311 defining the other end surface 311*a* of the recessed portion 31*b* is provided as a stopper portion (flange) 31*a*. Further, the mouthpiece section 31 has a central hole H1 formed therein to extend axially through the mouthpiece section 31 from the small-diameter portion 310 to the stopper portion 31*a* of the large-diameter portion 311.

The large-diameter portion 311 has a hole H2 formed in the recessed portion 31*b* and radially extending through an upper region (i.e., upper region in FIG. 2A) of the recessed portion 31*b*, and a pressure sensor 35 is inserted in the hole H2. The large-diameter portion 311 also has a cavity (not shown with a reference numeral) in a lower region (i.e., lower region in FIG. 2A) of the recessed portion 31*b* opposite to the hole H2.

The pressure sensor 35 moves along the center axis A as the mouthpiece section 31 is moved or displaced along the axis A, to detect pressure variation in the hole H1 formed in the mouthpiece section 31 and thereby detect pressure of breath blown by the human player via the small-diameter portion 310 of the mouthpiece section 31. Such pressure of breath blown by the human player via the small-diameter portion 310 of the mouthpiece section 31 will hereinafter be referred to also as "breath pressure".

The mouthpiece casing 32 includes two ring-shaped or annular projecting members 32*a* and 32*b* that project inwardly from an inner wall portion of the mouthpiece casing 32 toward and short of the center axis A and that are spaced from each other by a predetermined distance along the center axis A. The annular projecting member 32*b* supports the other end of the compression spring 33; namely, the compression spring 33 is provided between, and fixed at its opposite ends to, the end surface 311*b* of the annular recessed portion 31*b* and the annular projecting member 32*b*. The mouthpiece section 31 is axially movably supported at its outer peripheral surface by the inner peripheral surfaces of the annular projecting members 32*a* and 32*b*; namely, the mouthpiece section 31 is movable or displaceable in parallel to the center axis A while being supported by the annular projecting members 32*a* and 32*b*.

Further, a sliding volume control 34, which is a detector or detection section for detecting a physical amount caused by human player's operation on the mouthpiece section 31, is provided on a lower portion (i.e., lower portion in FIG. 2A) of the mouthpiece casing 32, and a sliding portion 34*a* movable along the center axis A as the mouthpiece section 31 is moved or displaced along the center axis A is inserted in the cavity (not shown with a reference numeral) opposite to the hole H2. A resistance value varying continuously (or at least in a multistep fashion) in response to the movement of the sliding portion 34*a* corresponds to an (axial) operational position of the mouthpiece section 31.

When no force is being applied to the mouthpiece section 31 in a direction toward the rear end of the mouthpiece casing 32 opposite from the front end of the mouthpiece casing 32 that is closer to the human player, the mouthpiece section 31 is held stationary by the compression spring 33 at a position where the stopper 31*a* and the projecting member 32*a* of the mouthpiece casing 32 abuttingly contact each other, as shown in FIG. 2A. As a force is applied to the mouthpiece section 31 in the direction toward the rear end of the casing 32, the compression spring 33 is compressed by the applied force, in response to which the mouthpiece section 31 moves toward the rear end of the casing 32 in parallel to the center axis A and the stopper 31*a* and the annular projecting member 32*a* of the mouthpiece casing 32 axially move away from each other.

A limit of the movement of the mouthpiece section 31 toward the rear end of the mouthpiece casing 32 is at a position where the compression spring 33 is compressed to the greatest extent as shown in FIG. 2B and where the stopper 31*a* and the mouthpiece casing 32 are spaced from each other by a distance L.

Whereas the foregoing has described the construction of the mouthpiece unit 3 in the first embodiment, it should be appreciated that the interior construction of the mouthpiece unit 3 is not necessarily limited to the foregoing as long as the mouthpiece casing 32 and the mouthpiece section 31 are slidable relative to each other and arrangements are made for detecting, at least in a multistep fashion, an operational position of the mouthpiece section 31 and pressure of breath blown into the mouthpiece section 31. The following describe a construction for the embodiment of the electronic wind instrument 1 to perform tone generation processing.

<Construction of Electronic Circuitry>

Figure 3:
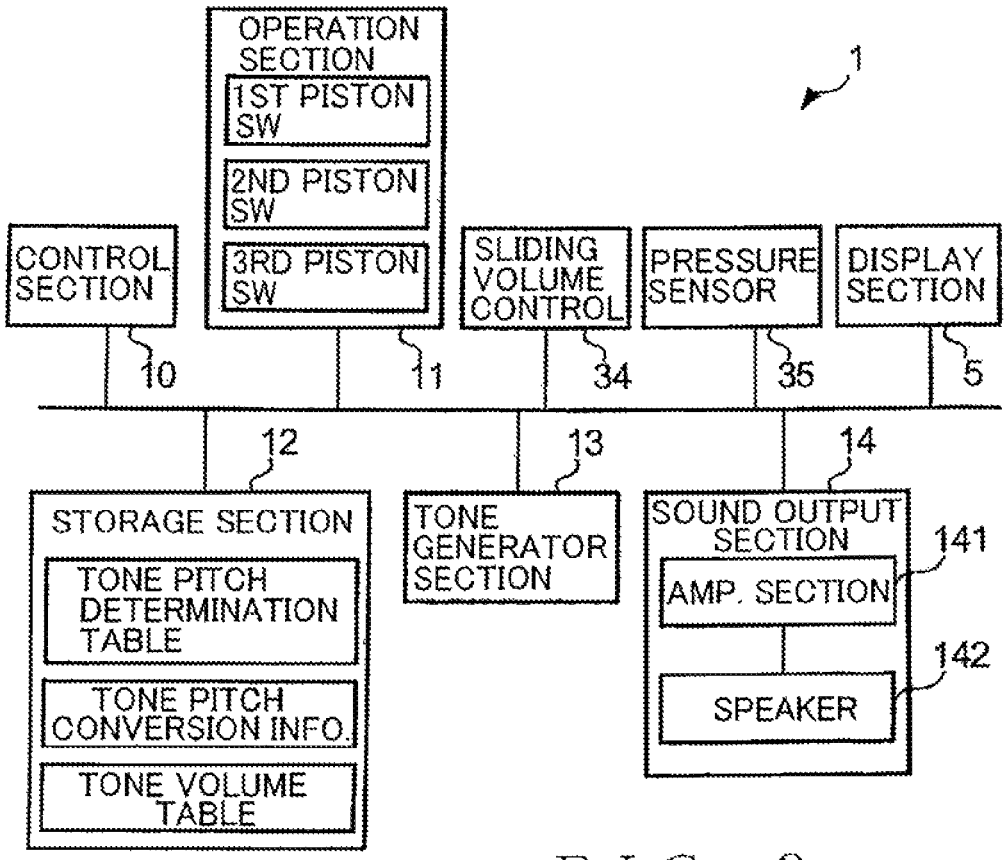
FIG. 3 is a block diagram showing a construction of the electronic wind instrument employing the first embodiment of the tone generating style notification control apparatus.

FIG. 3 is a block diagram showing an example construction of electronic circuitry for use in the tone generation processing by the electronic wind instrument 1. As shown in FIG. 3, the electronic wind instrument 1 includes, on the body casing 2, a control section 10, an operation section 11, a storage section 12, a tone generator section 13, a sound output section 14, and the above-mentioned sliding volume control 34, pressure sensor 35 and display section 5.

The control section 10 includes a CPU (Central Processing Unit), and a memory comprising a ROM (Read-Only Memory) and a RAM (Random Access Memory). By executing control programs stored in the ROM, the control section 10 controls various components connected to the control section 10. More specifically, the control section 10 not only identifies, as notification information, a tone pitch soundable at a moved-to position (i.e., current operating position) of the mouthpiece section 31 and causes the display section 5 to visually display a tone generating style based on the identified notification information, but also identifies tone generation instructing information indicative of a tone pitch corresponding to an operational state of the piston operation section 4 and an operational position of the mouthpiece section 31 and performs control to audibly generate a tone based on the tone generation instructing information and with a tone volume level corresponding to an intensity of breath blown by the human player into the mouthpiece section 31.

The operation section 11 includes a switch for turning on or off (i.e., switching between ON and OFF states of) a power supply (not shown) to the electronic wind instrument 1, and a first piston switch (SW), second piston switch and third piston switch corresponding to the first piston 4*a*, second piston 4*b* and third piston 4*c*, respectively, of the piston control section 4. In the instant embodiment, each of the piston switches outputs an ON/OFF signal indicative of whether or not the corresponding piston is currently in a depressed position. Note that an operation detection section for detecting an operational state of the piston operation section 4 may be in the form of a multistep switch or a continuous amount sensor.

The display section 5 is a display device in the form of LEDs, LCD and/or the like, which displays a tone generating style under control of the control section 10. The sliding volume control 34 is an example of a detection section for detecting a physical amount caused by operation performed on the mouthpiece section 31 with the human player's mouth. In the instant embodiment, the sliding volume control 34 detects an operational position of the mouthpiece section 31 having been moved by the human player (i.e., moved-to position of the mouthpiece section 31) and sends a result of the mouthpiece section position detection to the control section 10. The pressure sensor 35 is an example of a breath pressure detection section for detecting pressure of breath blown by the human player into the mouthpiece section 31, which detects pressure variation within the mouthpiece section 31 and sends a result of the pressure detection to the control section 10.

Figure 4A:
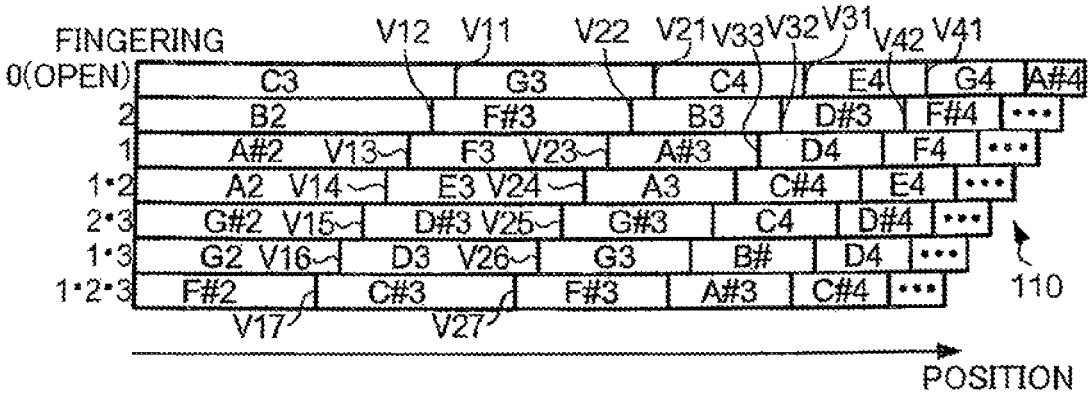
FIGS. 4A and 4B are diagrams showing examples of a tone pitch determination table and tone pitch conversion information employed in the first embodiment of the tone generating style notification control apparatus.
Figure 4B:
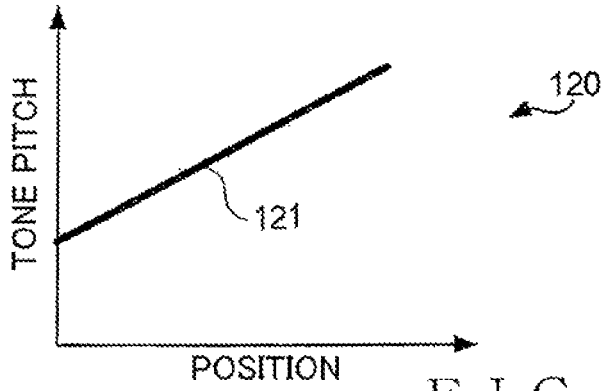
Figure 4C:
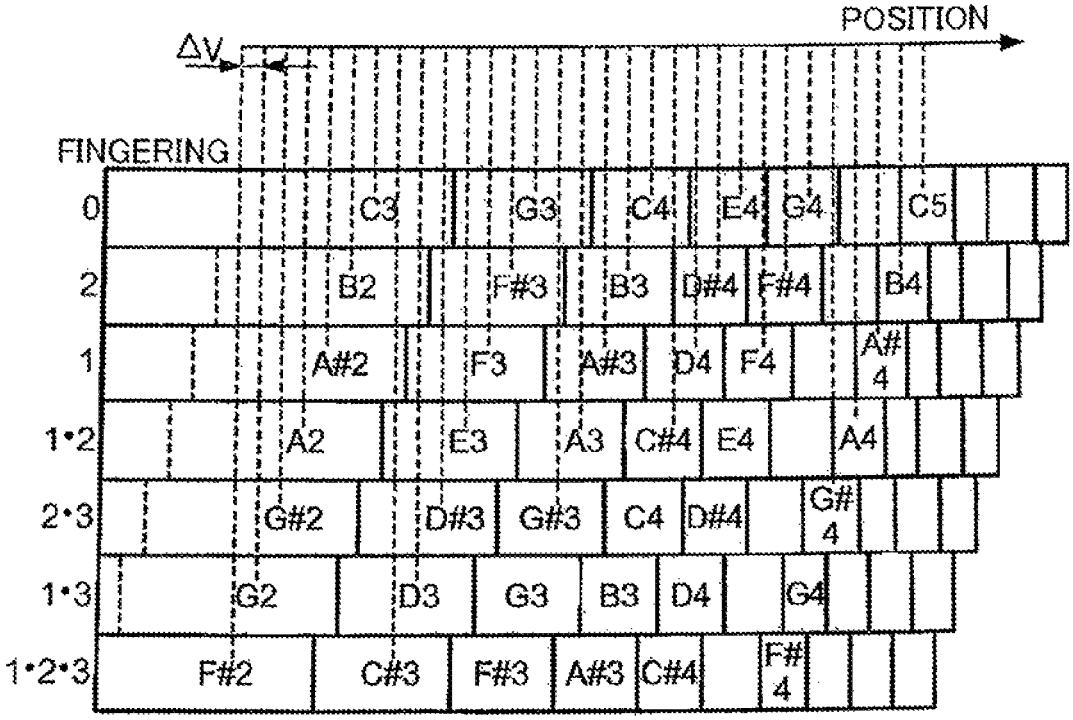
FIG. 4C is a diagram explanatory of relationship between various tone pitches and operating positions of a mouthpiece section in the first embodiment.
Figures 5, 6:
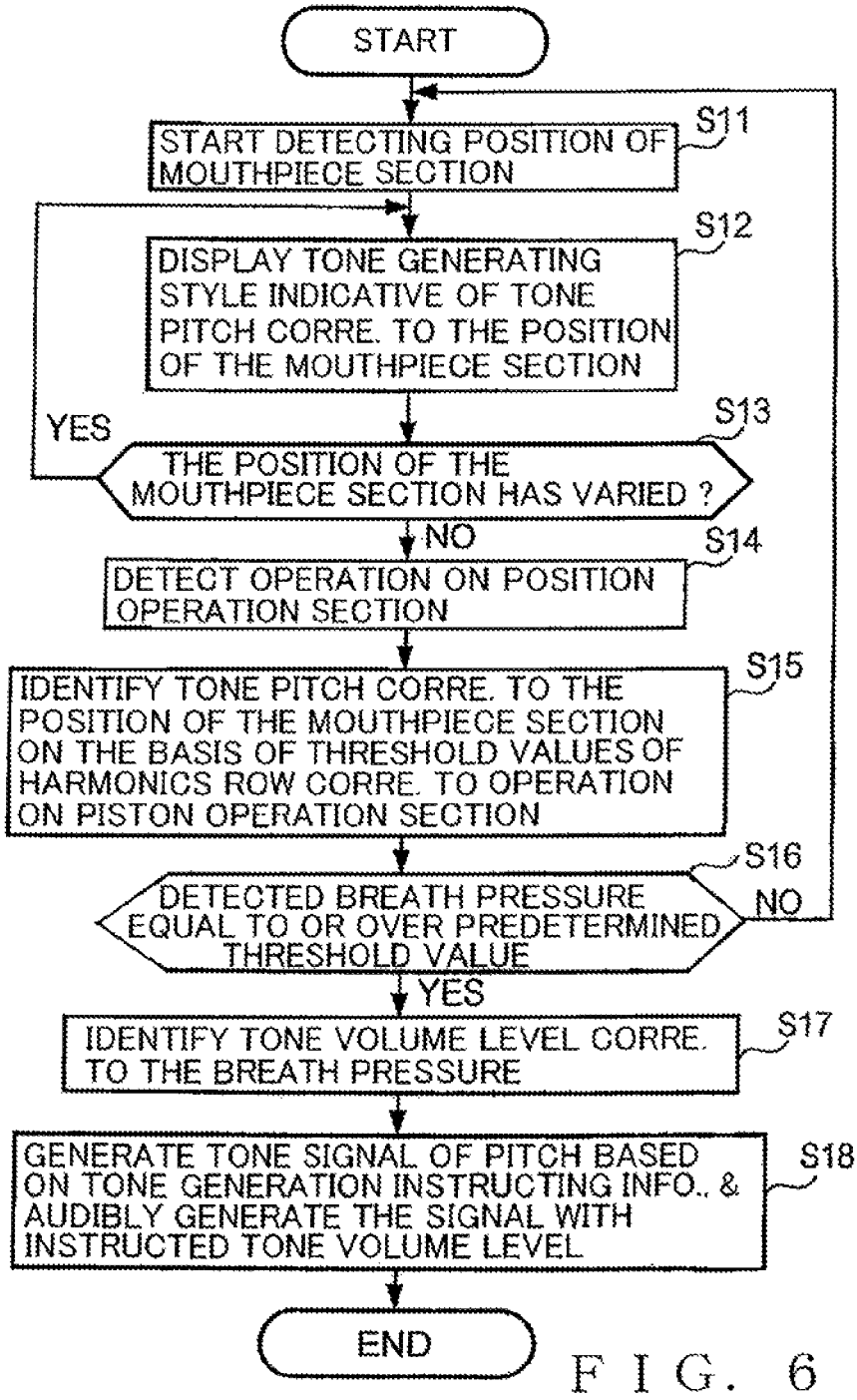
FIG. 5 is a diagram showing an example of a tone volume table employed in the first embodiment.
FIG. 6 is a flow chart of an example operational sequence of the electronic wind instrument employing the first embodiment of the tone generating style notification control apparatus.

The storage section 12, which is in the form of a non-volatile storage medium, stores therein various data, such as a tone pitch determination table 110 and tone pitch conversion information 120 that are examples of tone pitch information shown in FIG. 4, a tone volume table 130 shown in FIG. 5, and the like. Details of the tone pitch determination table 110, tone pitch conversion information 120 and tone volume table 130 will be discussed later. The tone generator section 13, which is for example a tone generator based on the MIDI (Musical Instrument Digital Interface) standards, generates a tone signal of a tone pitch instructed on the basis of instruction information given from the control section 10 and of a separately-selected musical instrument tone color, such as a trumpet tone color, and then sends the thus-generated tone signal to the sound output section 14. The sound output section 14 includes an amplification section 141 for amplifying the tone signal, input from the tone generator section 13, in accordance with an instruction from the control section 10, and a speaker 142 for audibly reproducing or sounding the amplified tone signal. The tone generator section 13 and the sound output section 14 together constitute an electronic tone generation mechanism.

<Data>

The following describe the data stored in the storage section 12. FIG. 4A shows an example of the tone pitch determination table 110. In the tone pitch determination table 110, as shown in FIG. 4A, there are defined threshold values (V11, V21, . . . ) of individual harmonics corresponding to various fingerings, and tone pitches (C3, G3, . . . ) corresponding to various positions of the mouthpiece section 31. In FIG. 4A, positions located more rightward in a direction of a rightward arrow represent operational positions of the mouthpiece section 31 depressed deeper into the mouthpiece unit 3, and the fingerings represent depressing operation of the first piston 4*a*, second piston 4*b* and third piston 4*c*.

More specifically, fingering "1" indicates depressing operation on the first piston 4*a*, fingering "2" indicates depressing operation on the second piston 4*b*, and fingering "3" indicates depressing operation on the third piston 4*c*. Further, fingering "0" indicates a state where all of the pistons are in the non-depressed, open position, fingering "1·2" indicates operation in which the first and second pistons 4*a* and 4*b* are depressed simultaneously, fingering "2·3" indicates operation in which the second and third pistons 4*b* and 4*c* are depressed simultaneously, fingering "1·3" indicates operation in which the first and third pistons 4*a* and 4*c* are depressed simultaneously, and fingering "1·2·3" indicates operation in which all of the pistons 4*a*, 4*b* and 4*c* are depressed simultaneously.

Each of the harmonics predetermined per fingering indicates what integer multiple of a fundamental vibrational mode of air column resonance corresponding to the fingering a vibration mode in question is. Threshold values of positions of the mouthpiece section 31 are preset in relation to each harmonics row where the order of harmonic sequentially increases like "2, 3, 4, 5, . . . " from the left end of the row corresponding to the fingering. In the illustrated example, threshold values of the harmonics row when the fingering is "1" are identified as smaller than V13 for the second-order harmonic, as equal to or greater than V13 but smaller than V23 for the third-order harmonic, as equal to or greater than V23 but smaller than V33 for the fourth-order harmonic, and so on. In the instant embodiment, the threshold values of the harmonics row corresponding to the current fingering operation are identified, and a tone pitch to be sounded is identified in accordance with the threshold values and current operational position of the mouthpiece section 31. Thus, if the operational position of the mouthpiece section 31 is equal to or greater than V13 but smaller than V23 when the fingering is "1", then tone pitch "F3" is identified as the tone pitch to be sounded.

FIG. 4B shows an example of the tone pitch conversion information 120. The tone pitch conversion information 120 predefines individual tone pitches, corresponding to various operational positions of the mouthpiece section 31, on the basis of a predefined mathematical expression or table indicated by a straight line 121 of FIG. 4B. FIG. 4C shows correspondency relationship between the positions indicated by the tone pitch conversion information 120 and the tone pitches indicated by the tone pitch determination table 110 of FIG. 4A. As indicated by broken lines in FIG. 4C, the positions of the mouthpiece section 31 and the tone pitches are associated with each other in one-to-one relationship such that every adjoining tone pitches are spaced from each other by a positional interval Δ V. In the instant embodiment, the pitch corresponding to the operational position of the mouthpiece section 31 is identified on the basis of the tone pitch conversion information 120.

FIG. 5 shows an example format and example data of the tone volume table 130. In the tone volume table 130, breath pressure levels and tone volume levels are prestored in association with each other. In FIG. 5, "Breath Pressure" indicates a range of breath pressure levels corresponding to an output value of the pressure sensor 35, and "Tone Volume Level" indicates a tone volume level with which a tone signal is to be output in the corresponding range of breath pressure levels (in the illustrated example of FIG. 5, P1<P2<P3<P4 . . . , and level 1<level 2<level 3 . . . ).

<Behavior>

The following describe behavior of the electronic wind instrument 1. FIG. 6 is a flow chart of an example operational sequence of the electronic wind instrument 1. Once the human player starts a performance with the mouthpiece section 31 of the electronic wind instrument 1 held in his or her mouth (i.e., between the lips), the control section 10 starts detecting the operational position of the mouthpiece section 31 by means of the sliding volume control 34, at step S11.

The control section 10 then identifies, as notification information, a tone pitch corresponding to the operational position of the mouthpiece section 31, detected at step S11, by referencing the tone pitch conversion information 120 stored in the storage section 12, and displays an expected tone generating style corresponding to the identified tone pitch, at step S12. The expected tone generating style is a style of a tone expected to be generated by the electronic wind instrument 1 in response to human player's operation on the mouthpiece section 31 with its (his or her) mouth, e.g., a tone pitch expected to be sounded in response to the human player's operation on the mouthpiece section 31. For example, if the detected current operational position of the mouthpiece section 31, having been depressed by the human player, corresponds to tone pitch "C3", then an indicator indicating tone pitch "C3", corresponding to the current operational position of the mouthpiece section 31, in such a manner that tone pitch "C3" is distinguishable from the other tone pitches is displayed on the display section 5 as the tone generating style.

With the display of such an indicator, the human player can confirm that the current operational position of the mouthpiece section 31 having been depressed thereby is in a harmonics state corresponding to tone pitch "C3". Then, the human player determines whether the tone corresponding to the current operational position of the mouthpiece section 31 coincides with its (his or her) desired tone, and, if not, the human player moves or adjusts the operational position of the mouthpiece section 31 so as to approach the desired tone.

Once the operational position of the mouthpiece section 31 varies by more than a predetermined amount (Δ V), i.e. once the mouthpiece section 31 is moved by the human player to an operational position corresponding to a tone pitch different from the tone pitch identified at step S12 above (YES determination at step S13), the control section 10 reverts to step S12, where it identifies a tone pitch corresponding to the moved-to position on the basis of the tone pitch conversion information 120 and displays, on the display section 5, a tone generating style indicative of the identified tone pitch.

With the mouthpiece section 31 having been placed at the operational position corresponding to the desired tone as above, the human player operates the piston operation section 4. If, on the other hand, the operational position of the mouthpiece section 31 has not varied by more than the predetermined amount (Δ V) (NO determination at step S13), the control section 10 detects human player's operation on the piston operation section 4 at step S14, identifies threshold values of a harmonics row corresponding to the fingering represented by the human player's operation on the piston operation section 4, and identifies, as tone generation instructing information, a pitch corresponding to the operational position of the mouthpiece section 31 detected at step S11, at step S15. If, in the illustrated example of FIG. 4C, the current operational position of the mouthpiece section 31 corresponds to a position corresponding to tone pitch "F3" (i.e., the mouthpiece section 31 is currently at the position corresponding to tone pitch "F3") and the operation of the piston operation section 4 represents fingering "1" (where the first piston is "ON" and the second and third pistons are "OFF"), the mouthpiece section 31 is located within the threshold value range of the third-order harmonic corresponding to fingering "1" in the tone pitch determination table 110, and thus, tone pitch "F3" is identified as a tone pitch to be sounded.

When the piston operation section 4 has been operated by the human player so as to execute fingering "0" (where all of the pistons are "OFF") while the mouthpiece section 31 is at the operational position corresponding to tone pitch "F3", tone pitch "G3" is identified as a tone pitch to be sounded, because, in this case, the mouthpiece section 31 is located within the threshold value range of the third-order harmonic corresponding to fingering "0" in the tone pitch determination table 110.

The human player blows breath into the hole H1 with the mouthpiece section 31 moved to the operational position corresponding to the desired tone and with the piston operation section 4 operated in the aforementioned manner. Then, the control section 10 detects, by means of the pressure sensor 35, the breath blown into the hole H1 by the human player. If the thus-detected breath pressure is equal to or over a predetermined threshold value (YES determination at step S16), the control section 10 references the tone volume table 130, stored in the storage section 12, to identify a tone volume level corresponding to the detected breath pressure, so that it instructs or indicates the identified tone volume level to the sound output section 14 and sends the tone generation instructing information, identified at step S15, to the tone generator section 13 (step S17).

The tone generator section 13 generates a tone signal of a tone pitch based on the tone generation instructing information sent from the control section 10 and outputs the thus-generated tone signal to the sound output section 14, where the amplification section 141 amplifies the tone signal, output from the tone generator section 13, in accordance with the tone volume level indicated or instructed by the control section 10 so that the amplified signal is audibly output or generated via the speaker 142 (step S18).

If no breath pressure equal to or over the predetermined threshold value is detected (NO determination at step S16), the control section 10 performs control to not generate a tone of the identified tone pitch and repeats the operations at and after step S11.

When the human player has positionally adjusted the mouthpiece section 31 to approach a desired tone, the above-described first embodiment allows the human player to confirm whether or not the mouthpiece section 31 is currently at a position corresponding to the desired tone. Thus, with the first embodiment, the desired tone can be generated reliably by the human player performing piston operation on the piston operation section 4 with the mouthpiece section 31 fixed at the operational position corresponding to the desired tone.

Second Embodiment

Next, a description will be given about an electronic wind instrument 1*a* employing a second embodiment of the present invention. In the following description, elements of the same constructions and functions as in the first above-described embodiment are indicated by the same reference numerals, and differences from the first embodiment will be mainly described hereinbelow.

<Outer Appearance and Construction>

Figure 8A:
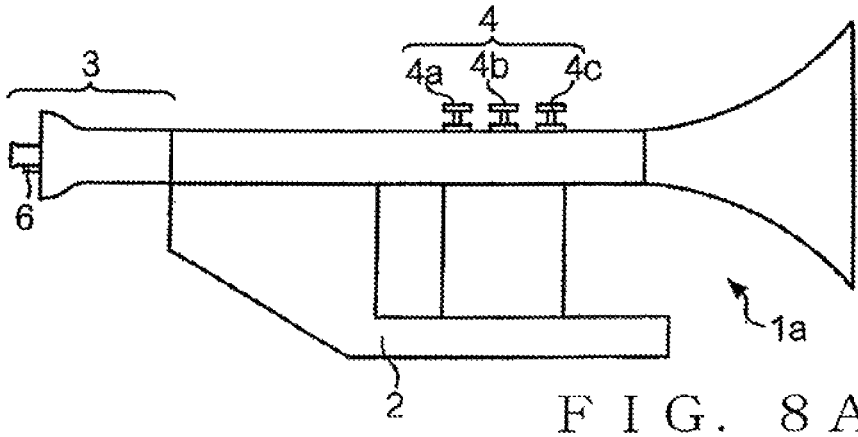
FIG. 8A is a view showing an example outer appearance of an electronic wind instrument 1*a* employing a second embodiment of the tone generating style notification control apparatus of the present invention.
Figure 8B:
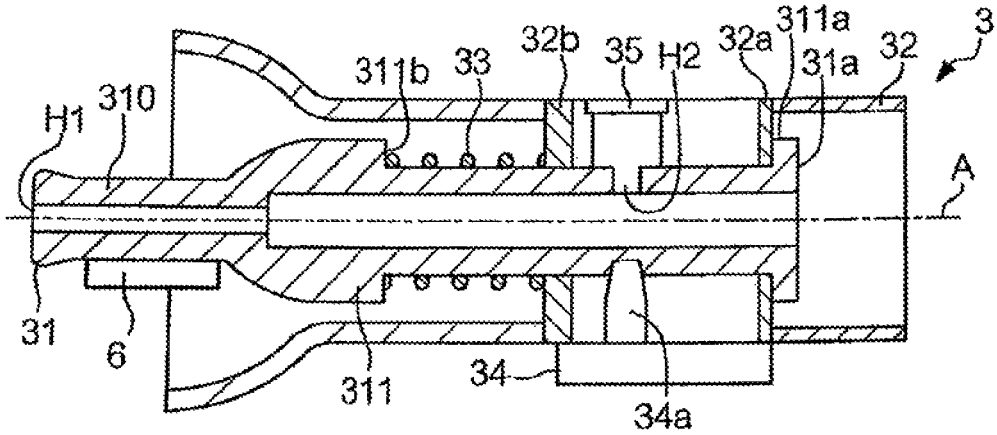
FIG. 8B is a sectional view showing the interior of a mouthpiece unit employed in the electronic wind instrument employing the second embodiment.
Figure 9:
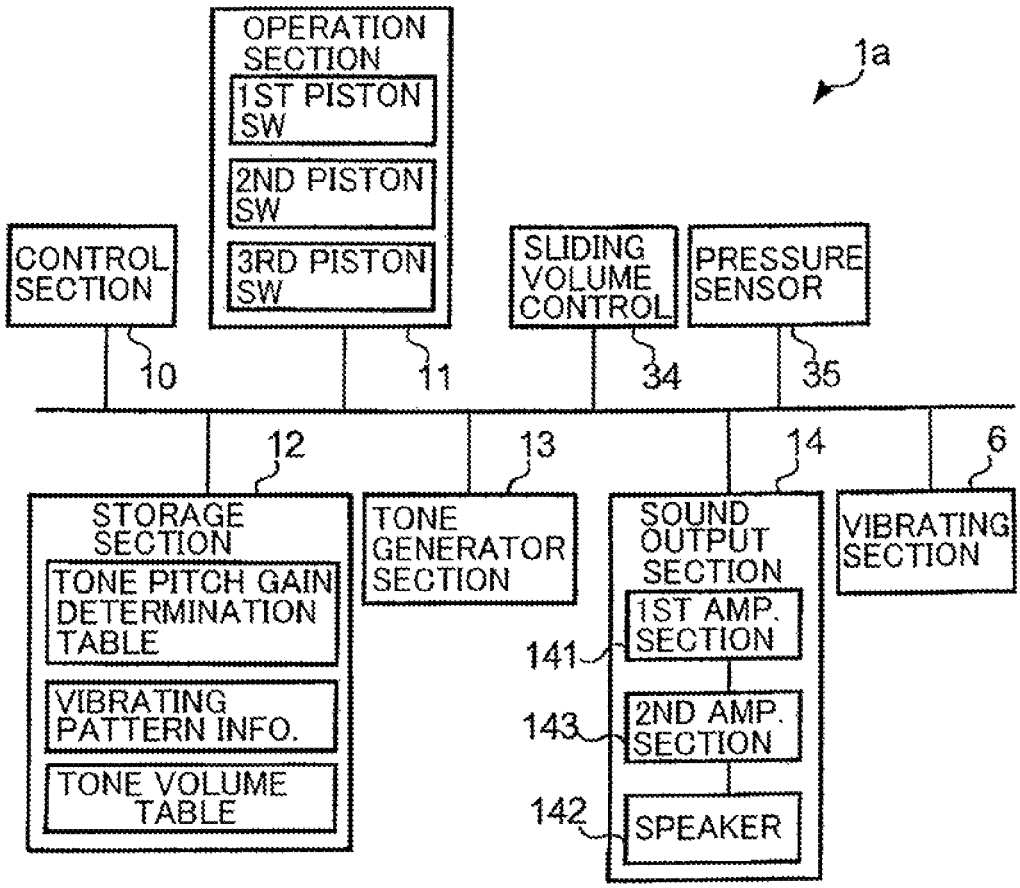
FIG. 9 is a block diagram showing a construction of the electronic wind instrument employing the second embodiment.

FIG. 8 is a view showing an example outer appearance of the electronic wind instrument 1*a* employing the second embodiment of the tone generating style notification control apparatus of the present invention. As shown in FIGS. 8A and 8B, the electronic wind instrument 1*a* is different from the above-described electronic wind instrument 1 employing the first embodiment of the tone generating style notification control apparatus in that it includes a vibrating section 6 provided on the mouthpiece section 31 of the mouthpiece unit 3. More specifically, the electronic wind instrument 1*a* employing the second embodiment is different from the electronic wind instrument 1 employing the first embodiment in that the vibrating section 6 is provided in place of the display section 5, and in that the storage section 12 has a tone pitch/gain determination table and vibrating pattern information stored therein, as shown in FIG. 9.

The vibrating section 6 includes a vibrator that transmits to the outside a vibration signal as mechanical vibration, and, under control of the control section 10, the vibrating section 6 generates a vibration signal corresponding to an instructed frequency, and adjusts the vibration signal in accordance with an instructed gain so that the vibrator of the vibrating section 6 is caused to vibrate in accordance with the adjusted vibration signal. Whereas the vibrator in the second embodiment will be described below as an electromagnetic vibrator, the vibrator may be in the form of a so-called vibrating motor that rotates an eccentric weight. The storage section 12 stores therein a tone volume table 130 similar to that provided in the first embodiment, the tone pitch/gain determination table 220 and the vibrating pattern information 230 shown in FIG. 11.

The sound output section 14 includes a first amplification section 141 having a similar function to the amplification section 141 provided in the first embodiment, the speaker 142 for audibly reproducing or sounding a tone signal, and a second amplification section 143 for adjusting the tone signal, amplified by the first amplification section 141, in accordance with a gain instructed by the control section 10 and outputting the thus-adjusted tone signal to the speaker 142. The following describe the data stored in the storage section 12 in the second embodiment.

<Data>

Figure 10:
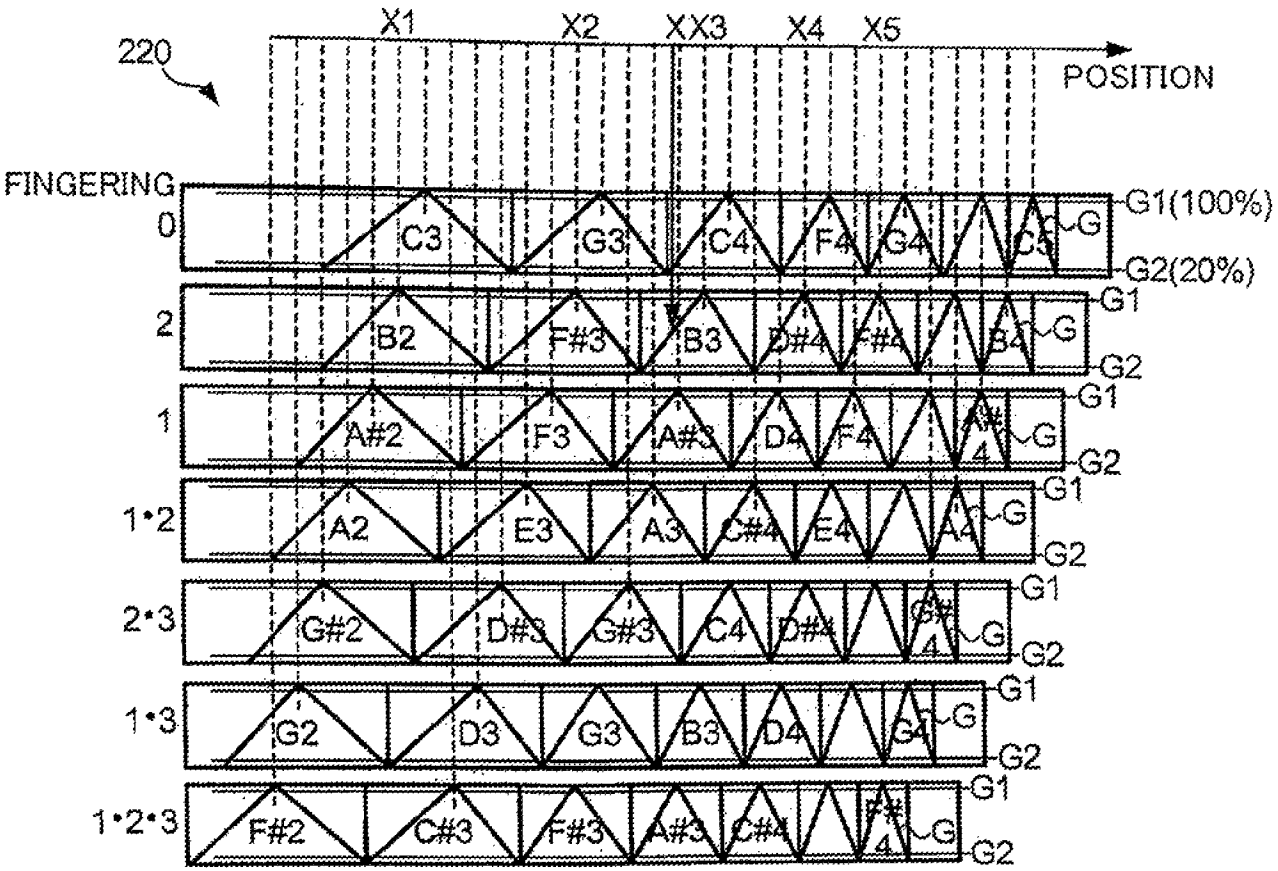
FIG. 10 is a diagram showing an example of a tone pitch/gain determination table employed in the second embodiment.

The tone pitch/gain determination table 220 shown in FIG. 10 is a table predefining, for each of various operational states of the piston operation section 4, a gain value (vertical axis of the table) corresponding to an amount of movement or displacement (horizontal axis of the table) of the mouthpiece section 31. More specifically, tone pitches corresponding to individual fingerings and ranges of movement (i.e., movement ranges) of the mouthpiece section 31 corresponding to individual tone pitches are predefined as the tone pitch table, and gain information indicated by straight lines G and corresponding to positions of the mouthpiece section 31 is preset per tone pitch as the gain table. As the gain information, gains of the sound output section 14 and vibration section 6 are each set at 100% (as indicated by an upper horizontal solid line G1 in FIG. 10) when the mouthpiece section 31 is at a predetermined position (hereinafter referred to "reference point" in the movement range movement corresponding to any one of the tone pitches. Further, when the mouthpiece section 31 is not at the reference point in the range of movement corresponding to any one of the tone pitches, the sound output section 14 and vibration section 6 are each set at a gain ratio corresponding to a distance or deviation from the reference point. For example, as indicated by oblique straight lines G in FIG. 10 for fingering "2", X1, X2, X3, . . . indicating substantial midpoints of the movement ranges corresponding to the tone pitches are the reference points corresponding to the tone pitches. The gain information is defined in such a manner that the gain when the mouthpiece section 31 is at each of these midpoints is set at 100%, and the gain decreases at a predetermined rate toward a minimum gain value of 20% (as indicated by a lower horizontal solid line G2 in FIG. 10) as the mouthpiece section 31 deviates away from the reference point. In this manner, the tone volume and vibration of the vibrator of the vibrating section 6 is maximized when the mouthpiece section 31 is at the reference point, and the tone volume and vibration of the vibrator becomes smaller as the mouthpiece section 31 deviates from the reference point.

In the case of the natural or acoustic trumpet, how a tone sounds depends on a vibrating state of human player's lips. Thus, in the instant embodiment, the reference point of each tone pitch is made a position where a tone of that pitch resonates most, so that the human player can recognize variation in resonance corresponding to individual operational positions of the mouthpiece section 31. Further, in the instant embodiment, variation in resonance is notified to the human player by the tone volume and mechanical vibration of the vibrator being varied depending on how deep the mouthpiece section 31 is depressed into the mouthpiece casing 32.

Figure 11:
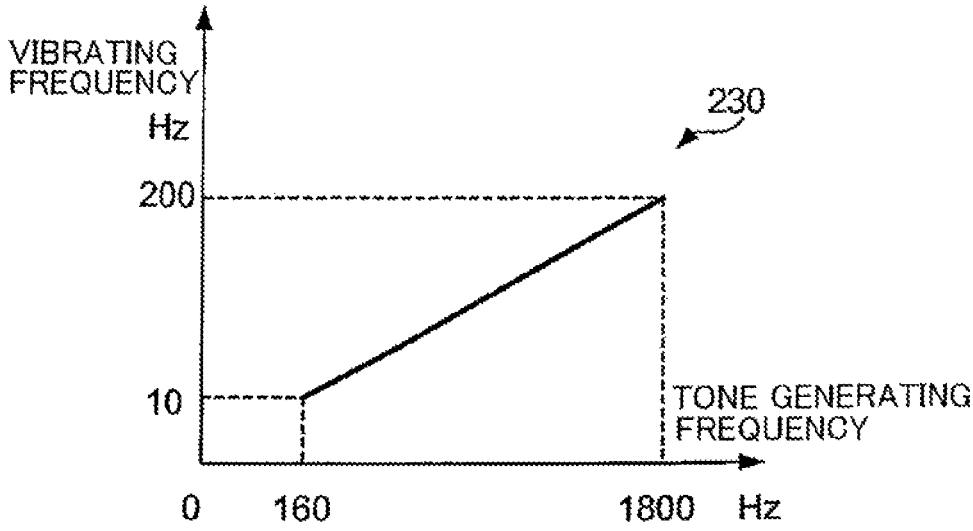
FIG. 11 is a diagram showing an example of vibrating pattern information employed in the second embodiment.
Figure 12:
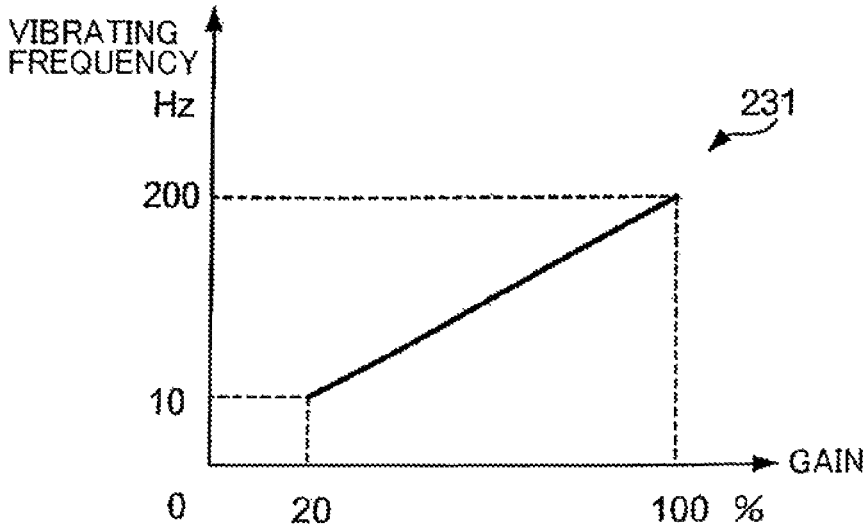
FIG. 12 is a diagram showing a modified example of the vibrating pattern information employed in the second embodiment.

The following describe the vibrating pattern information 230. FIG. 11 shows an example of the vibrating pattern information 230 employed in the second embodiment. The vibrating pattern information 230 defines a frequency with which to vibrate the vibrating section 6 (more specifically, vibrator) in accordance with a frequency of a tone pitch to be sounded. In the illustrated example of FIG. 11, frequencies 160-1,800 Hz of tones playable by the trumpet are shown on the horizontal axis as frequencies of tone pitches (tone generating frequencies), and vibrator vibrating frequencies corresponding to the frequencies of tone pitches (tone generating frequencies) are set as 10-200 Hz on the vertical axis. In this case, vibration of the vibrating frequency corresponding to the tone pitch is controlled in level in accordance with a gain. Alternatively, the vibrating frequency of the vibrating section 6 may be controlled in accordance with a gain, in which case vibrating pattern information 231 defining vibrating frequencies (10-200 Hz) corresponding to gain ratios (20-100%) may be used.

<Behavior>

Figure 13:
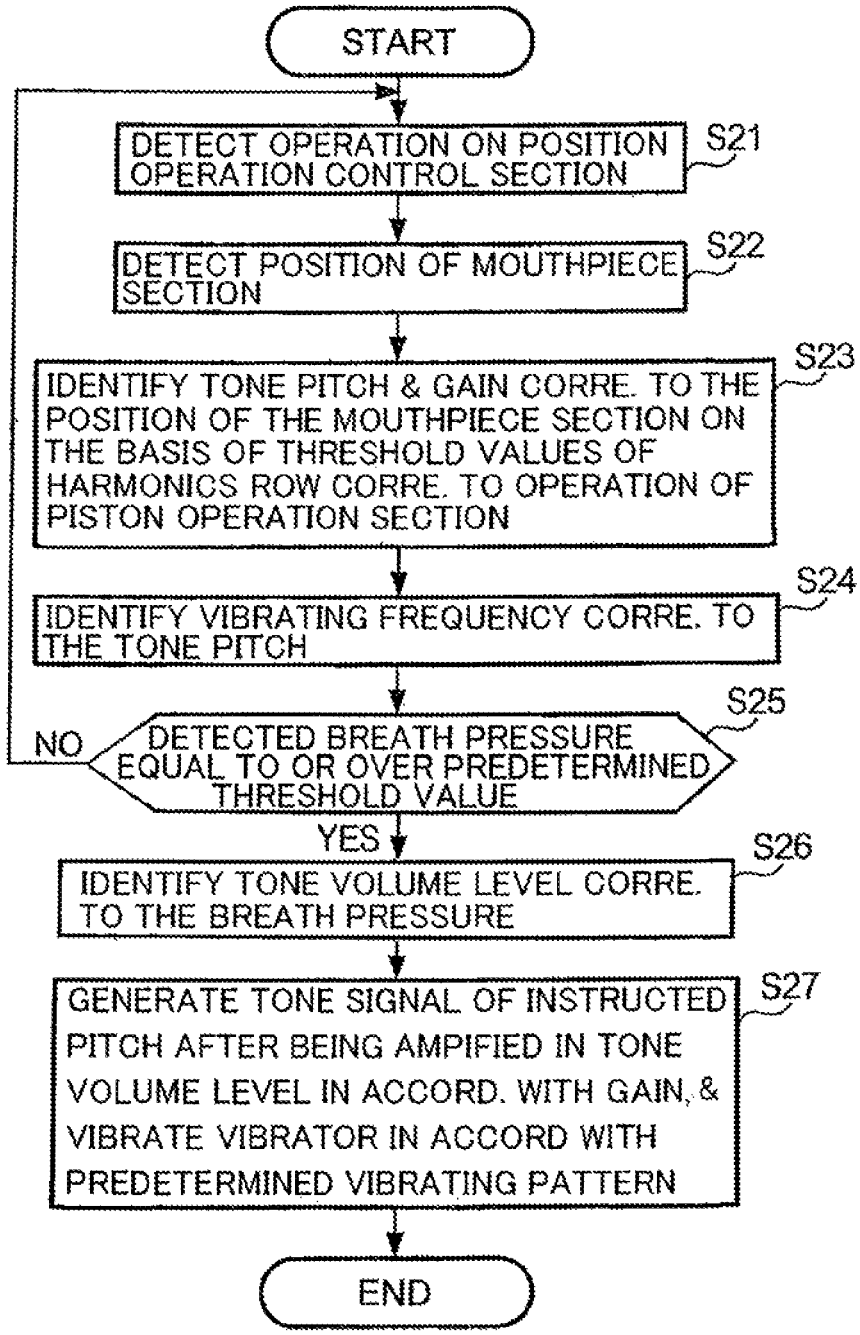
FIG. 13 is a flow chart of an example operational sequence of the electronic wind instrument employing the second embodiment.

The following describe behavior of the electronic wind instrument 1*a* employing the second embodiment of the invention. FIG. 13 is a flow chart of an example operational sequence of the electronic wind instrument 1*a*. Once the human player starts a performance with the mouthpiece section 31 of the electronic wind instrument 1*a* held in his or her mouth (i.e., between the lips), the control section 10 starts detecting operation of the piston operation section 4 at step S21 and starts detecting an operational position of the mouthpiece section 31 by means of the sliding volume control 34 at step S22.

If the human player operates the piston operation section 4 with fingering "2", the control section 10 references the tone pitch/gain determination table 220, stored in the storage section 12, to identify movement ranges of the mouthpiece section 31 corresponding to a harmonics row of fingering "2". For example, once the human player moves the mouthpiece section 31 to a position X indicated by a downward solid-line arrow, the control section 10 not only identifies tone pitch "B3" as a tone pitch to be sounded, corresponding to fingering "2" and position X, but also identifies, for example, 50% as a gain corresponding to the position X on the basis of the gain information in the tone pitch/gain determination table 220 (step S23).

Further, the control section 10 sets the frequency of the tone pitch, identified at step S23, as a tone generating frequency, and identifies a vibrating frequency corresponding to the tone generating frequency on the basis of the vibrating pattern information 230 stored in the storage section 12 (step S24).

Further, the control section 10 detects breath, blown by the human player into the hole H1 of the mouthpiece section 31, by means of the pressure sensor 35, and, if the thus-detected breath pressure is equal to or over a predetermined threshold value (YES determination at step S25), the control section 10 references the tone volume table 130, stored in the storage section 12, to identify a tone volume level corresponding to the detected breath pressure at step S26.

Then, the control section 10 indicates, to the sound output section 14, the gain identified at step S23 and the tone volume level identified at step S26, indicates, to the tone generator section 13, the tone pitch identified at step S23 and also indicates, to the vibrating section 6, the gain identified at step S23 and the vibrating frequency identified at step S24.

The tone generator section 13 generates a tone signal of the tone pitch indicated or instructed by the control section 10 and outputs the thus-generated tone signal to the sound output section 14, where the first amplification section 141 amplifies the tone signal, output from the tone generator section 13, so that the tone signal assumes the tone volume level indicated by the control section 10. Further, the tone signal having been amplified by the first amplification section 141 is adjusted by the second amplification section 143 in accordance with the gain indicated by the control signal 10 and then output to the speaker 142. Furthermore, the vibrating section 6 generates a vibration signal based on the vibrating frequency indicated by the control section 10 and adjusts the vibration signal in accordance with the gain instructed by the control section 10 so that the vibrator is vibrated by the adjusted vibration signal in accordance with a predetermined vibrating pattern (step S27).

In the above-described example, the tone signal of tone pitch "B3" is audibly generated or sounded after having been adjusted by the first amplification section 141 to assume the tone volume level corresponding to the detected breath pressure and then adjusted by the second amplification section 143 so that the tone signal decreases in level to 50%. Further, the gain of the vibration signal based on the vibrating frequency corresponding to tone pitch "B3" is adjusted to 50% so that the vibrator is caused to vibrate in accordance with the thus-adjusted vibration signal. Because the gain is set at 100% when the mouthpiece section 31 is at an operational position corresponding to reference point "X3" of tone pitch "B3", a tone signal of the maximum tone volume level corresponding to the breath pressure is output to the speaker 142, and the vibrator is vibrated in accordance with the vibration signal generated by the vibrating section 6.

Furthermore, if the breath pressure detected by the pressure 35 is below the predetermined threshold value (NO determination at step S25), the control section 10 reverts to step S21 to repeat the operations from steps S21 to S25. Namely, if the detected breath pressure is below the predetermined threshold value, the tone of the pitch identified at step S22 is not generated, and the mouthpiece section 31 does not vibrate either.

Namely, when a tone of a pitch corresponding to a detected operational position of the mouthpiece section 31 is to be sounded, the above-described second embodiment can not only vary the tone volume in accordance with the operational position of the mouthpiece section 31 and distance or deviation of the operational position of the mouthpiece section 31 from the reference point of the tone pitch, but also vary a vibrating pattern with which to vibrate the vibrator and hence the mouthpiece section 31. Thus, the instant embodiment can provide an indicator that is indicative of resonance of the cylinder of the mouthpiece section 31 and corresponds to the operational position of the mouthpiece section 31 and human player's piston operation, and the tone volume and vibration of the mouthpiece section 31 is maximized if the operational position of the mouthpiece section 31 coincides with the resonance of the cylinder. As a result, the human player can execute an intuitive performance with a feeling as if the human player were playing a natural or acoustic trumpet.

<Modifications>

The present invention should not be construed as limited to the above-described embodiments and may be modified variously as exemplified below. Further, various modifications explained below may be combined as desired.

(1) Whereas the first embodiment of the present invention has been described above as notifying the human player of a harmonics state, corresponding to an operational position of the mouthpiece section 31, by displaying a tone generating style on the display section 5. The way of notifying the human player of a tone generating style is not limited to the aforementioned. For example, a vibrating section having a vibrator may be provided on the mouthpiece section 31 or the like as in the above-described second embodiment, and the vibrating section may be vibrated with a vibrating frequency corresponding to a tone pitch represented by an operational position of the mouthpiece section; for example, the vibrator may be vibrated with a low vibrating frequency when the operational position of the mouthpiece section represents a low tone pitch, with a high vibrating frequency when the operational position of the mouthpiece section represents a high tone pitch, in a vibrating style where the vibrator is vibrated intermittently at predetermined time intervals corresponding to a note name, or in any desired combination of the above-mentioned. Note that the vibrating section 6 may be provided on or near the piston operation section 4, rather than on the mouthpiece section 31, in such a manner that vibration of the vibrator can be transmitted to at least one hand of the human player operating the piston operation section 4. Alternatively, the vibrating section 6 may be provided separately from the electronic wind instrument 1 in such a manner that a vibrating signal output from the control section 10 can be received by the vibrating section 6 via wired or wireless communication and vibration of the vibrating section 6 can be transmitted to another body part of the human player than body parts contacting the electronic wind instrument 1. Further, the electronic wind instrument 1 may, for example, include a terminal for connection thereto of headphones in such a manner that a tone of a pitch corresponding to an operational position of the mouthpiece section 31 can be output from the headphones connected to the terminal in order to audibly notify an expected tone generating style.

Figure 7:
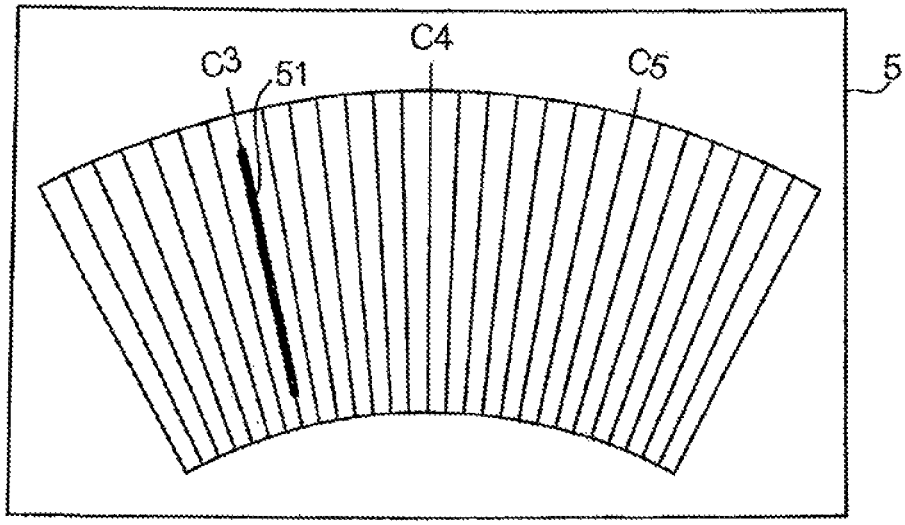
FIG. 7 is a diagram showing an example of a tone generating style displayed in the first embodiment of the tone generating style notification control apparatus.
Figure 14:
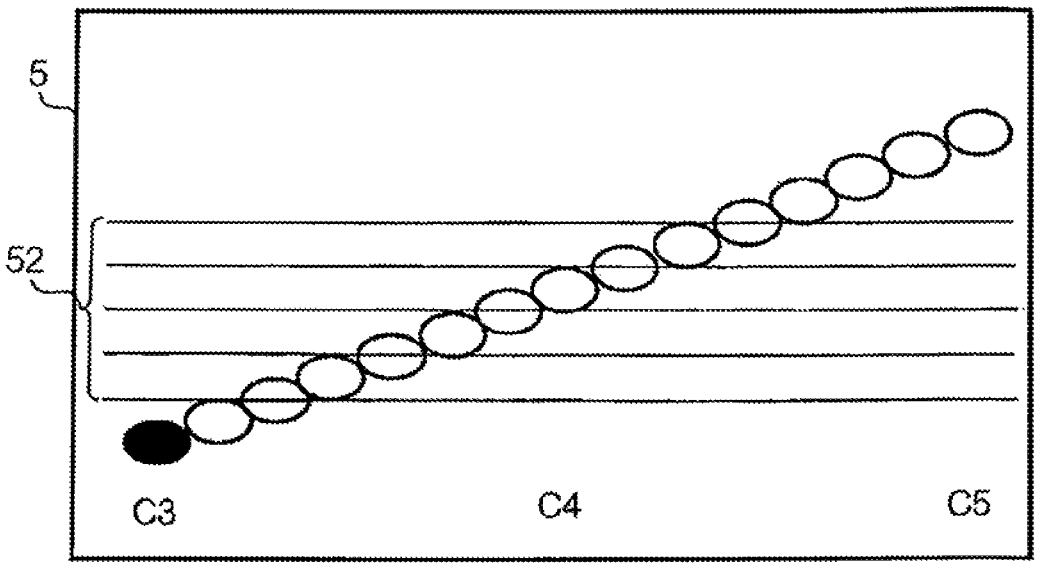
FIG. 14 is a diagram showing an example of a tone generating style displayed in a modification of the tone generating style notification control apparatus of the present invention.

(2) Whereas the above-described first embodiment is constructed to display a tone generating style, indicative of a tone pitch 51 corresponding to an operational position of the mouthpiece section 31, in the fashion shown in FIG. 7, before the human player performs piston operation on the piston operation section 4, a tone pitch identified in accordance with the piston operation and operational position of the mouthpiece section 31 may be displayed in the fashion of FIG. 7 when the human player has perform piston operation. As another alternative, a staff 52 may be displayed as shown in FIG. 14 so that a position of an identified tone pitch ("C3" in the illustrated example of FIG. 14) can be displayed on the staff 52 in a distinguishable manner from other tone pitches. As still another alternative, multi-color display elements may be provided and particular tone pitches may be associated in advance with respective ones of the colors, in which case a tone pitch to be sounded can be displayed by the corresponding color and a tone volume with which to sound the tone can be displayed by a light intensity. As a further modification of the above-described first embodiment, when the mouthpiece section 31 is at an operational position between two adjoining tone pitches, positions corresponding to the two adjoining tone pitches may be displayed in a blinking manner, or any one of the two tone pitches (e.g., lower or higher of the two tone pitches) may be displayed.

(3) Further, the above-described first embodiment is constructed to display, as the tone generating style, a tone pitch corresponding to a moved-to position (current operational position) of the mouthpiece section 31. As a modification of the above-described first embodiment, a pressure sensor may be provided on the mouthpiece section 31 for detecting, as a physical amount caused by human player's operation on the mouthpiece section 31, pressure with which the human player presses the lips against the mouthpiece section 31, and a tone pitch corresponding to the detected pressure may be displayed as the tone generating style. In this case, tone pitch information, in which various possible output values of the pressure sensor and tone pitches are associated with each other, may be stored so that a tone generating style indicative of a tone pitch corresponding to an output value from the pressure sensor provided on the mouthpiece section 31 can be displayed in generally the same manner as in the first embodiment.

(4) Whereas the first embodiment of the present invention has been described above as applied to an electronic wind instrument used as a tone generation apparatus, it may be applied to an acoustic or natural wind instrument. In such a case, a pressure sensor may be provided on the mouthpiece of the acoustic or natural wind instrument and values output from the pressure sensor when the human player plays tones of individual pitches may be prestored in association with the individual pitches, so that a tone pitch corresponding to an output result (value) of the pressure sensor can be notified to the human player in generally the same manner as in the above-described first embodiment. As an alternative, a sensor for detecting an operational state of the pistons may be provided in addition to the pressure sensor provided on the mouthpiece, and various tone pitches may be prestored in association with values output from the pressure sensor and operational states of the pistons when the human player plays tones of the individual pitches, so that a tone pitch corresponding to output results (values) of the pressure sensor and the pistons can be notified to the human player in generally the same manner as in the above-described first embodiment. Note that the above-described second embodiment too may be applied to an acoustic or natural wind instrument in the same manner as set forth above in relation to the first embodiment.

(5) Whereas the above-described first embodiment is constructed to identify one tone pitch in accordance with an operational position of the mouthpiece section 31, the first embodiment may be modified in such a manner that it identifies a plurality of potential tone pitches likely to be generated in correspondence with a combination of the operational position of the mouthpiece section 31 and fingering. In this case, at least one tone generating style indicative of any of the identified tone pitches that satisfies a predetermined condition, such as the lowest or highest one of the tone pitches may be notified, or a tone generating style indicative of all of the identified tone pitches may be notified.

(6) Further, whereas the above-described second embodiment of the present invention is constructed to notify variation in resonance, corresponding to an operational position of the mouthpiece section 31, by a tone volume (tone vibration level) and mechanical vibration of the vibrator, such variation in resonance may be notified by other means than the aforementioned. For example, a display section 5 may be provided on the electronic wind instrument 1*a* as in the first embodiment, and information indicative of a gain corresponding to an operational position of the mouthpiece section 31 may be visually displayed on the display section 5, or positional relationship between the reference point of a tone pitch corresponding to piston operation and the operational position of the mouthpiece section 31 and the operational position of the mouthpiece section 31 may be visually displayed on the display section 5. Alternatively, one of the tone pitch and gain may be notified by mechanical vibration of the vibrator, and the other of the tone pitch and gain may be visually displayed on the display section 5.

(7) Further, whereas the above-described second embodiment of the present invention is constructed to adjust a tone volume level corresponding to breath pressure in accordance with a gain corresponding to an operational position of the mouthpiece section 31, a tone color and quality of a tone pitch corresponding to piston operation and the operational position of the mouthpiece section 31 may be varied in accordance with the operational position of the mouthpiece section 31.

Figure 15:
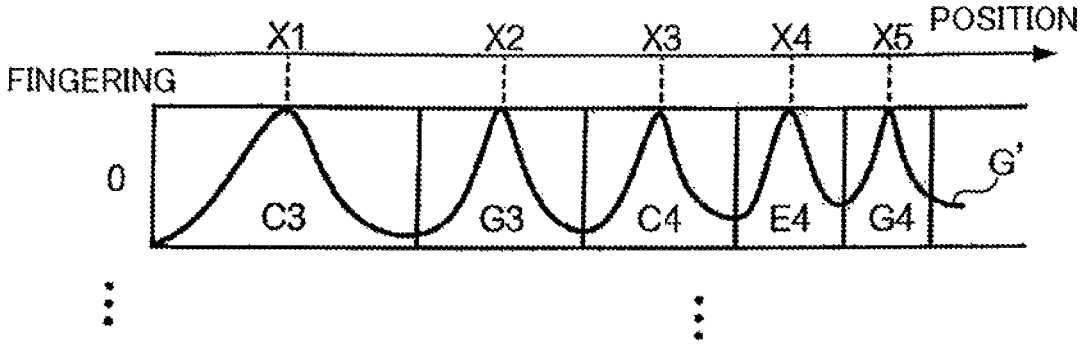
FIG. 15 is a diagram explanatory of gain information employed in a modification of the tone generating style notification control apparatus of the present invention.

(8) Further, the second embodiment of the present invention has been described above in relation to the case where each tone pitch represented by an operational position of the mouthpiece section 31 is varied linearly as a characteristic of the tone pitch/gain determination table of FIG. 10. Alternatively, the tone pitch/gain determination table may be constructed in such a manner that the gain is varied as indicated by a curve line G in FIG. 15 with the reference point of the tone pitch as a peak gain level. In such a case, there may be prestored a gain table in which gains are individual positions of the mouthpiece section 31 are associated with each other in advance in one-to-one relationship. Two such gain tables may be defined in correspondence with both of a depressing direction of the mouthpiece section 31 and a returning direction of the mouthpiece section 31 so that any one of the two gain tables can be selected in accordance with a moving direction (i.e., depressing direction or returning direction).

(9) Furthermore, whereas the above-described second embodiment of the present invention is constructed to notify variation in resonance, corresponding to an operational position of the mouthpiece section 31, by a tone volume and vibration of the vibrator, such variation in resonance may be notified by any one of the tone volume and vibration of the vibrator.

(10) Furthermore, the second embodiment of the present invention has been described above in relation to the case where tone pitches and gain information corresponding to moved-to positions of the mouthpiece section 31 are predefined. As a modification of the second embodiment, a pressure sensor may be provided on the mouthpiece section 31 for detecting, as a physical amount caused by human player's operation on the mouthpiece section 31, pressure with which the human player's lips are pressed against the mouthpiece section 31, and intensities of pressure with which the human player's lips are pressed against the mouthpiece section 31, tone pitches and gain information may be predefined so that a tone volume and vibration of the vibrator can be adjusted in accordance with the gain information corresponding to an output value from the pressure sensor provided on the mouthpiece section 31.

(11) The first and second embodiments of the tone generating style notification control apparatus of the present invention have been described above as applied to an electronic wind instrument, such as a trumpet. As another embodiment, the basic principles of the present invention may be applied or implemented as a program which notifies a tone generating style on the basis of a value of a pressure sensor and gain information output from the electronic wind instrument.

(12) Whereas the first and second embodiments have been described above in relation to the case where a tone of a trumpet tone color is generated, the present invention may be applied to still another application where a tone of another brass wind instrument, such as a trombone or cornet, is generated. In such a case, a table predefining relationship among various fingerings corresponding to a musical instrument of a tone color to be sounded, operating positions of the mouthpiece section 31 and harmonics may be stored in the storage section 12, and the tone generating style notification control may be performed using such a table. Further, the present invention may be applied to another application where a tone of a woodwind instrument is generated. In such a case, there may be stored a table indicative of relationship between tone pitches and various values of pressure with which a reed is held between human player's lips, and pressure with which the reed is held between the human player's lips or a physical amount corresponding to such pressure may be detected so that tone generating style notification control can be performed using the table. Further, for each of a plurality of musical instrument tone colors, a table predefining relationship among various fingerings corresponding to a musical instrument of that tone color, operating positions of the mouthpiece section 31 and harmonics may be prestored in the storage section 12. In this case, one of the tables is selected in accordance with selection of any one of the musical instrument tone colors, so that the tone generating style notification control can be performed using the selected table.

(13) The first embodiment has been described above in relation to the case where both information for identifying a tone pitch to be displayed and information for identifying a tone pitch at the time of tone generation is identified using the tone pitch determination table, separate tables having both of such information stored therein may be prestored.

This application is based on, and claims priorities to, JP PA 2010-217709 filed on 28 Sep. 2010 and JP PA 2010-217710 filed on 28 Sep. 2010. The disclosure of the priority applications, in its entirety, including the drawings, claims, and the specification thereof, are incorporated herein by reference.

What is claimed is:

1. A tone generating style notification control apparatus for a musical instrument having a mouthpiece section and a body section, the mouthpiece section being operable with a mouth of a human player, said tone generating style notification control apparatus comprising:

a detector which detects a physical amount caused by operation performed on the mouthpiece section with the mouth of the human player;

a storage section which stores therein information defining relationship between various values or ranges of the physical amount and tone pitches;

an identification section which, by referencing said storage section, identifies a tone pitch corresponding to the physical amount detected via said detector; and a notification section which notifies the human player of an expected tone generating style on the basis of the tone pitch identified by said identification section, the expected tone generating style being a style of a tone expected to be generated by the musical instrument in response to the operation performed on the mouthpiece section with the mouth of the human player, wherein the mouthpiece section is displaceable relative to the body section, and wherein the physical amount detected by said detector is an operational position of the mouthpiece section responsive to displacement of the mouthpiece section relative to the body section.

2. The tone generating style notification control apparatus as claimed in claim 1, wherein said notification section includes at least one selected from a group of a display which notifies the expected tone generating style by visual display, a vibrating mechanism which notifies the expected tone generating style by mechanical vibration, and a device which notifies the expected tone generating style in an audible manner.

3. The tone generating style notification control apparatus as claimed in claim 1, wherein the expected tone generating style is a tone pitch of the tone expected to be generated by the musical instrument in response to the operation performed on the mouthpiece section with the mouth of the human player.

4. The tone generating style notification control apparatus as claimed in claim 3, wherein:

said identification section identifies a plurality of tone pitches likely to be sounded by the musical instrument, and said notification section notifies at least one of the plurality of tone pitches likely to be sounded by the musical instrument.

5. The tone generating style notification control apparatus as claimed in claim 1, wherein:

the musical instrument further comprises:

an operation section operable with a human player; and an operation detection section which detects an operational state of said operation section, and the tone generating style notification control apparatus further comprises a tone pitch identification section which detects, on the basis of a combination of the physical amount detected via said detector and the operational state of said operation section detected via said operation detection section, a tone pitch of a tone to be generated by the musical instrument, and which generates tone-pitch instructing data instructing the identified tone pitch.

6. The tone generating style notification control apparatus as claimed in claim 5, further comprising:

a sensor which detects pressure of breath blown by the human player into the mouthpiece section, wherein a tone volume level of the tone to be generated in accordance with the tone-pitch instructing data is identified in accordance with the pressure of breath detected via said sensor.

7. The tone generating style notification control apparatus as claimed in claim 1, wherein the musical instrument is an electronic or natural wind instrument.

8. A musical instrument comprising:

a body section;

a mouthpiece section operable with a mouth of a human player, an operation section operable with at least one finger of the human player;

a tone generation mechanism which generates a tone on the basis of a combination of operation performed on the mouthpiece section with a mouth of the human player and operation performed on said operation section with the finger of the human player; and a tone generating style notification control apparatus comprising:

a detector which detects a physical amount caused by operation performed on the mouthpiece section with the mouth of the human player;

a storage section which stores therein information defining relationship between various values or ranges of the physical amount and tone pitches;

an identification section which, by referencing said storage section, identifies a tone pitch corresponding to the physical amount detected via said detector; and a notification section which notifies the human player of an expected tone generating style on the basis of the tone pitch identified by said identification section, the expected tone generating style being a style of a tone expected to be generated by the musical instrument in response to the operation performed on the mouthpiece section with the mouth of the human player, wherein the mouthpiece section is displaceable relative to the body section, and wherein the physical amount detected by said detector is an operational position of the mouthpiece section responsive to displacement of the mouthpiece section relative to the body section.

9. A computer-implemented method for of notifying a tone generating style for a musical instrument having a mouthpiece section and a body section, the mouthpiece section being operable with a mouth of a human player, said method comprising:

a step of receiving, from a detector which detects a physical amount caused by operation performed on the mouthpiece section with the mouth of the human player, information indicative of the physical amount detected by the detector;

an identification step of identifying a tone pitch corresponding to the detected physical amount by referencing a storage section storing therein information defining relationship between the physical amount and a tone pitch; and a step of notifying the human player of an expected tone generating style on the basis of the tone pitch identified by said identification step, the expected tone generating style being a style of a tone expected to be generated by the musical instrument in response to the operation performed on the mouthpiece section with the mouth of the human player, wherein the mouthpiece section is displaceable relative to the body section, and wherein the physical amount detected by the detector is an operational position of the mouthpiece section responsive to displacement of the mouthpiece section relative to the body section.

10. A tone generating style notification control apparatus for a musical instrument having a mouthpiece section, the mouthpiece section being operable with a mouth of a human player, said tone generating style notification control apparatus comprising:

a detector which detects a physical amount caused by operation performed on the mouthpiece section with the mouth of the human player;

a first storage section which stores therein a tone pitch table defining relationship between various ranges of the physical amount and tone pitches;

a second storage section which stores therein a gain table defining, as gain information, values corresponding to deviations of the physical amount from a predetermined reference point, for each tone pitch and within the range of the physical amount corresponding to the tone pitch;

an identification section which, with regard to the physical amount detected by said detector, identifies a tone pitch by referencing the tone pitch table and identifies gain information by referencing the gain table; and a notification section which notifies the human player of the tone pitch and the gain information identified by said identification section, wherein said notification section notifies a combination of the tone pitch and the gain information by a combination of a vibrating frequency and vibrating level of mechanical vibration.

11. The tone generating style notification control apparatus as claimed in claim 10, wherein said notification section notifies the tone pitch and the gain information by visual display.

12. The tone generating style notification control apparatus as claimed in claim 10, wherein:

the musical instrument further comprises:

an operation section operable with a finger of the human player; and an operation detection section which detects an operational state of said operation section, and said identification section identifies a tone pitch of a tone to be generated by the musical instrument, by referencing the tone pitch table on the basis of a combination of the physical amount detected by said detector and the operational state detected by said operation detection section.

13. The tone generating style notification control apparatus as claimed in claim 12, further comprising:

a sensor which detects pressure of breath blown by the human player into the mouthpiece section, and wherein a tone volume level of the tone to be generated by the musical instrument is identified in accordance with a combination of the pressure of breath detected by said sensor and the gain information.

14. The tone generating style notification control apparatus as claimed in claim 10, wherein the musical instrument is an electronic or natural wind instrument.

15. A musical instrument comprising:

a mouthpiece section;

an operation section operable with a finger of a human player;

a tone generation mechanism which generates a tone on the basis of a combination of operation performed on the mouthpiece section with a mouth of the human player and operation performed on said operation section with the finger of the human player; and a tone generating style notification control apparatus comprising:

a detector which detects a physical amount caused by operation performed on the mouthpiece section with the mouth of the human player;

a first storage section which stores therein a tone pitch table defining relationship between various ranges of the physical amount and tone pitches;

a second storage section which stores therein a gain table defining, as gain information, values corresponding to deviations of the physical amount from a predetermined reference point, for each tone pitch and within the range of the physical amount corresponding to the tone pitch;

an identification section which, with regard to the physical amount detected by said detector, identifies a tone pitch by referencing the tone pitch table and identifies gain information by referencing the gain table; and a notification section which notifies the human player of the tone pitch and the gain information identified by said identification section, wherein said notification section notifies a combination of the tone pitch and the gain information by a combination of a vibrating frequency and vibrating level of mechanical vibration.

16. A computer-implemented method of notifying a tone generating style for a musical instrument having a mouthpiece section, the mouthpiece section being operable with a mouth of a human player, said method comprising:

a step of receiving, from a detector which detects a physical amount caused by operation performed on the mouthpiece section with the mouth of the human player, information indicative of the physical amount detected by the detector;

a pitch identification step of identifying a tone pitch corresponding to the detected physical amount by referencing a tone pitch table, stored in a first storage section, defining relationship between the physical amount and a tone pitch;

a gain identification step of, for each tone pitch and within the range of the physical amount corresponding to the tone pitch, identifying gain information from a gain table, stored in a second storage section, values corresponding to deviations of the physical amount from a predetermined reference point; and a notifying step of notifying the human player of the tone pitch and the gain information identified by said pitch identification step and said gain identification coction step, wherein said notification step notifies a combination of the tone pitch and the gain information by a combination of a vibrating frequency and vibrating level of mechanical vibration.

* * * * *